US008869939B2

(12) United States Patent
Kuo et al.

(10) Patent No.: US 8,869,939 B2
(45) Date of Patent: Oct. 28, 2014

(54) EXTENSION LADDER

(76) Inventors: Ching Yao Kuo, Taipei (TW); Norman William Liefke, Surrey (CA)

( * ) Notice: Subject to any disclaimer, the term of this patent is extended or adjusted under 35 U.S.C. 154(b) by 214 days.

(21) Appl. No.: 13/120,775

(22) PCT Filed: Sep. 25, 2008

(86) PCT No.: PCT/CN2008/001650

§ 371 (c)(1),
(2), (4) Date: Mar. 24, 2011

(87) PCT Pub. No.: WO2010/034135

PCT Pub. Date: Apr. 1, 2010

(65) Prior Publication Data

US 2011/0192679 A1 Aug. 11, 2011

(51) Int. Cl.

| | |
|---|---|
| ***E06C 1/12*** | (2006.01) |
| ***E06C 7/08*** | (2006.01) |
| ***E06C 7/42*** | (2006.01) |

(52) U.S. Cl.

CPC ..... *E06C 1/125* (2013.01); *E06C 7/086* (2013.01); *E06C 7/42* (2013.01)

USPC ..... 182/195; 182/228.1; 182/228.4; 182/228.6

(58) Field of Classification Search

USPC ..... 182/107, 108, 109, 111, 195, 228.1, 182/228.4, 228.6

See application file for complete search history.

(56) References Cited

U.S. PATENT DOCUMENTS

| | | | | |
|---|---|---|---|---|
| 5,341,899 | A * | 8/1994 | Casamento | 182/205 |
| 5,551,529 | A * | 9/1996 | Molitor | 182/204 |
| 5,743,355 | A * | 4/1998 | McDonnell et al. | 182/195 |
| 6,708,800 | B2 * | 3/2004 | Kieffer et al. | 182/195 |
| 6,799,660 | B1 * | 10/2004 | Crawford | 182/200 |
| 7,316,293 | B2 | 1/2008 | Ching-Yao | |
| 8,011,475 | B2 * | 9/2011 | Wang | 182/195 |
| 8,056,679 | B2 * | 11/2011 | Hong | 182/195 |
| 8,066,099 | B2 * | 11/2011 | Liang | 182/195 |
| 2004/0020718 | A1 * | 2/2004 | Kieffer et al. | 182/195 |
| 2004/0195043 | A1 * | 10/2004 | Johansson | 182/195 |
| 2005/0067224 | A1 * | 3/2005 | Brewster | 182/108 |
| 2009/0050407 | A1 * | 2/2009 | Eriksson | 182/195 |
| 2009/0065304 | A1 * | 3/2009 | Jian | 182/209 |

* cited by examiner

*Primary Examiner* — Katherine Mitchell
*Assistant Examiner* — Colleen M Chavchavadze
(74) *Attorney, Agent, or Firm* — Bacon & Thomas, PLLC

(57) ABSTRACT

An extension ladder comprises a plurality of ladder sections, connection kits and transverse step beams. Each ladder section is a hollow rail, which can be interconnected by telescoping with each other. A snap-fit mechanism is provided between the upper ladder section and the lower ladder section to make them not slip when the ladder is extended. The upper end of each ladder section is provided with a connection kit. The upper end of the connection kit is provided with a fixed protuberant pin, an inside thereof is provided with a locking mechanism which is provided with a turning key. An outside of the connection kit is covered by the transverse step beam. When the upper and lower connection kits are close to each other, the protuberant pin of the lower connection kit pushes the turning key so that the locking mechanism of the upper connection kit can be unlocked.

15 Claims, 21 Drawing Sheets

EXTENSION LADDER

BACKGROUND OF THE INVENTION

1. Field of the Invention

The present invention relates to an improved extension ladder structure, and more particularly to an extension ladder apparatus, which is assembled and folded easily (i.e. telescoping) and securely, providing superior safety.

2. Description of the Prior Art

Accordingly, stepladders have become a requisite tool for casual use. For example, climbing tools such as a ladder or scaffolding enable people to readily process construction or obtain the objects at a high place.

A conventional stepladder 800, as shown in FIG. 1, is assembled by two side rails having a footpad respectively to prevent slippage, and is provided with parallel spaced step portions therein. The stepladder appears as an A-frame ladder during usage.

Stepladders are typically large and bulky; therefore, it is uneasy and inconvenient to carry them. Moreover, the storage of a folded stepladder may occupy large space, which makes the use of a stepladder inflexible.

Various extension ladder structures have been disclosed in U.S. Pat. Nos. 4,989,692, 5,492,430, 5,495,915, 2004/0195043A, 6,708,800, and 5,743,355 to improve the fixed stepladder as shown in FIG. 1A. However, the extension ladders in those applications still require respective control during folding and cannot achieve the automatic folding, which is not ideal for use.

To improve the shortcomings of existing extension ladders, the Chinese Patent No. 200620113407.6 named "Extension Ladder" has been issued on Apr. 29, 2006 and the Utility Model No. 899705 has been obtained.

Referring to FIG. 1B, which is the partial view of the extension stepladder in the Chinese patent No. 200620113407.6, after a locking mechanism within the first-length transverse step portion is pulled, with a tie rod plate 801 that can be held up and down, one end of the tie rod plate 801 extends to the upper end of the cross hole, the out-protruding part is inserted into the lower end cross hole 802 of the upper transverse step portion, and then the turning rod 803 disposed within the upper transverse step portion is pushed so that the locking bar withdraws from the upper transverse step portion to unlock. Accordingly, the locking mechanism above the second length can be unlocked in order and each length of the side rail sections will go down and be folded.

However, after the Chinese Patent No. 200620113407.6 described above has been completed, through constantly tests, it is found that when an extension ladder is used in a dirty environment, the holes above or under the step portions may be filled with dust and other contaminants so that the tie rod plate cannot be moved smoothly, which will cause unlock failure or other problems.

Also, unlocking requires the tie rod plate 801 to push the turning rod 803. If a tie rod plate 801 gets stuck or cannot pass through the cross hole, the entire stepladder cannot be folded smoothly which causes inconvenience while using it.

As to the side rail sections that can be fit in with each other, since there is no effective locking mechanism, the upper side rail section may depart from the lower side rail section when they are used erroneously, which causes unsafety.

Accordingly, the present invention has been invented to solve the above-mentioned problems occurred in the prior art.

SUMMARY OF THE INVENTION

Accordingly, the present invention aims at improving an extension ladder structure which comprises a plurality of rail side sections, connection kits, locking mechanism and transverse step portion, makes the structure simpler, safer, and more stable, and can solve the above-mentioned problems occurred in conventional extension ladders. Since transmission parts are largely decreased, the parts that need further process and technology are also reduced, which save costs and reduce manufacturing difficulties. Furthermore, the locking mechanism is completely hidden, which can reduce the risk of mistaken unlocking. Also, a confirmation window for the locking bolt is provided in the present invention, which facilitates the safety confirmation before using the extension ladder.

In the improvement of an extension ladder structure in the present invention, fixing ejection bar is provided at the upper end of the connection kit that is used to fit onto the side rail section. A locking mechanism is provided within the connection kit. One end of the connection kit is covered by a transverse step portion. Accordingly, when the fixing ejection bar of the lower connection kit is inserted upward into the upper connection kit, the locking mechanism within the upper connection kit can be pushed to unlock. Since the ejection bar is a fixed device, any damage caused by external force or problems that lead to unable to perform operations can be avoided. This is another objective of the present invention.

In the improvement of an extension ladder structure in the present invention, an unlocking block that can be fit onto the upper end of the fixing ejection bar is provided, and an partition ejection bar that is equal to the ejection bar is provided at the upper end of the unlocking block. When the unlocking block is fit onto the upper end of said fixing ejection bar, a locking mechanism within the upper connection kit can be pushed by the ejection bar, so that a space between the upper step portion and lower step portion remain during the folding, which allows cables or wires to be passed through or allows operators who need to wear gloves in a long time to hold the ladder easily when the extension ladder is used in any specific location. This is another objective of the present invention.

In the improvement of an extension ladder structure in the present invention, an elastic support set is disposed at the bottom of said extension ladder, which not only increases the basal area of said extension ladder and enhances the safety, but also suitable for adjustment in different places or uneven ground (step differences) to increase the applicable scope and locations and enhance the stability. This is another objective of the present invention.

In the improvement of an extension ladder structure in the present invention, a locking mechanism that will not be skidded is disposed between the upper side rail section and lower side rail section. This is another objective of the present invention.

The detailed structure, application principle, function, and effects of the present invention will be more apparent from the following descriptions taken in conjunction with the accompanying drawings.

DETAILED DESCRIPTION OF THE EMBODIMENTS

Figure 1A:
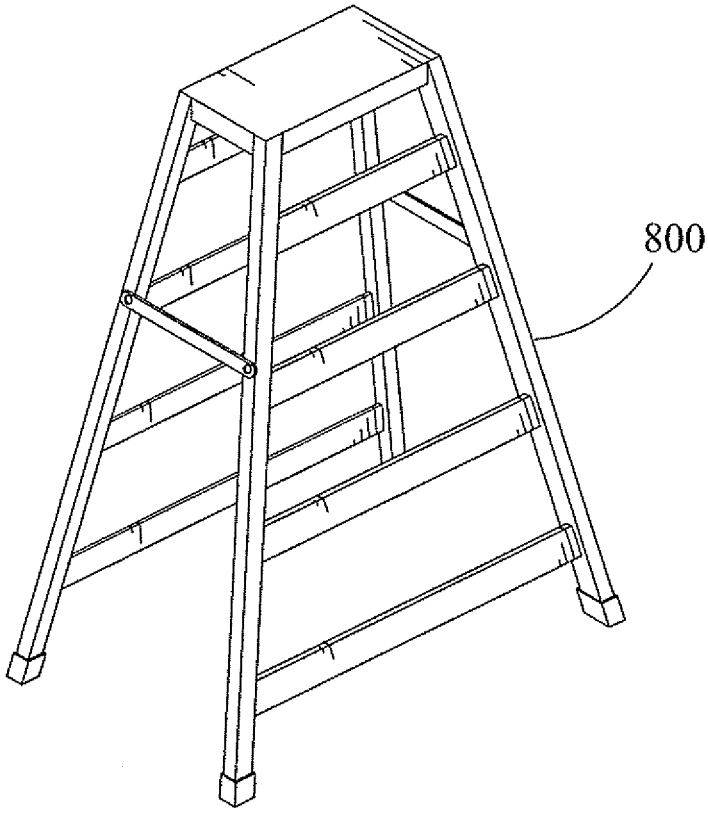
Fig. 1A (Prior Art)
FIG. 1A is a three-dimensional view of the conventional ladder.
Figure 1B:
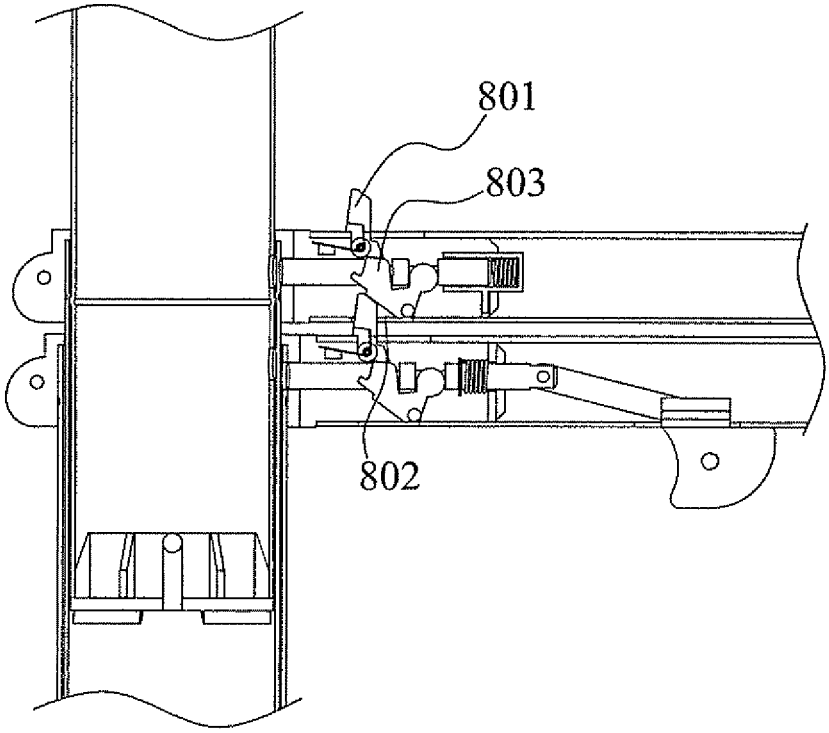
Fig. 1B (Prior Art)
FIG. 1B is a partial sectional view of the Patent No. 095108511.
Figure 2:
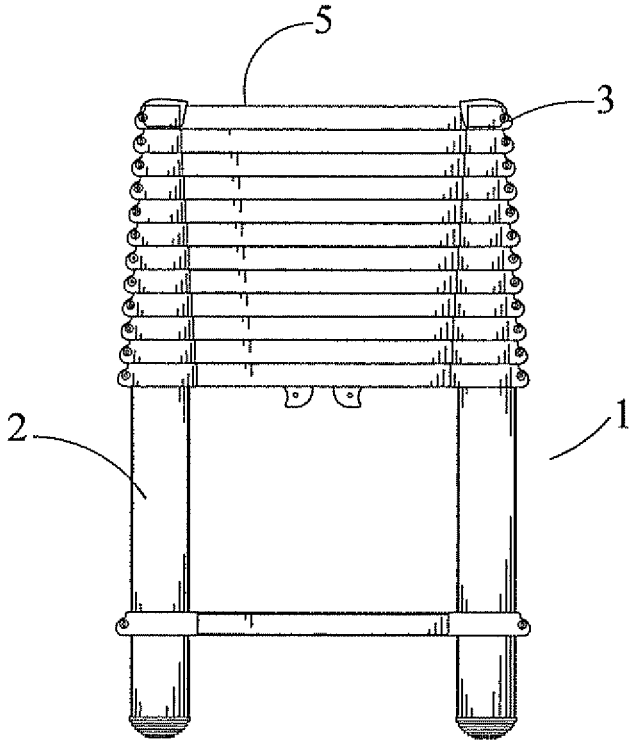
FIG. 2 is an illustration showing the folding of the extension ladder in the present invention.
Figure 3:
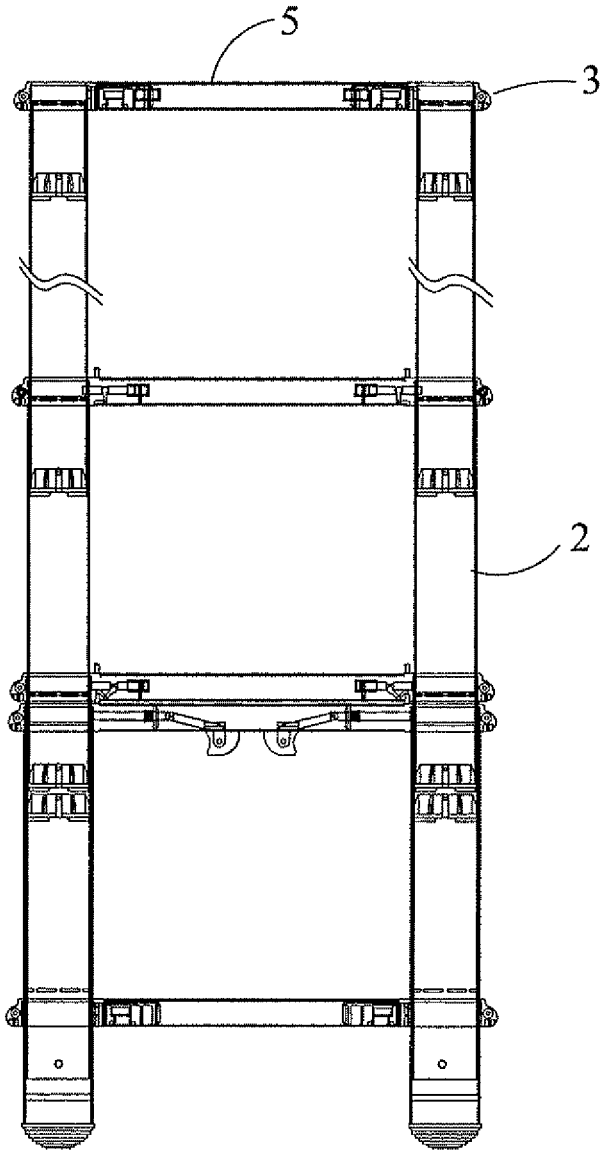
FIG. 3 is an illustration showing the extension of the extension ladder in the present invention.

The present invention discloses the improvement of an extension ladder structure wherein the extension ladder 1 can be folded as shown in FIG. 2 or unfolded as shown in FIG. 3. Said extension ladder 1 comprises a plurality of side rail sections 2, connection kits 3, and transverse step portion 5, which is present as a stepladder extending upward when it is unfolded and each of its side rail sections can be fit in with each other when it is folded.

Figure 4:
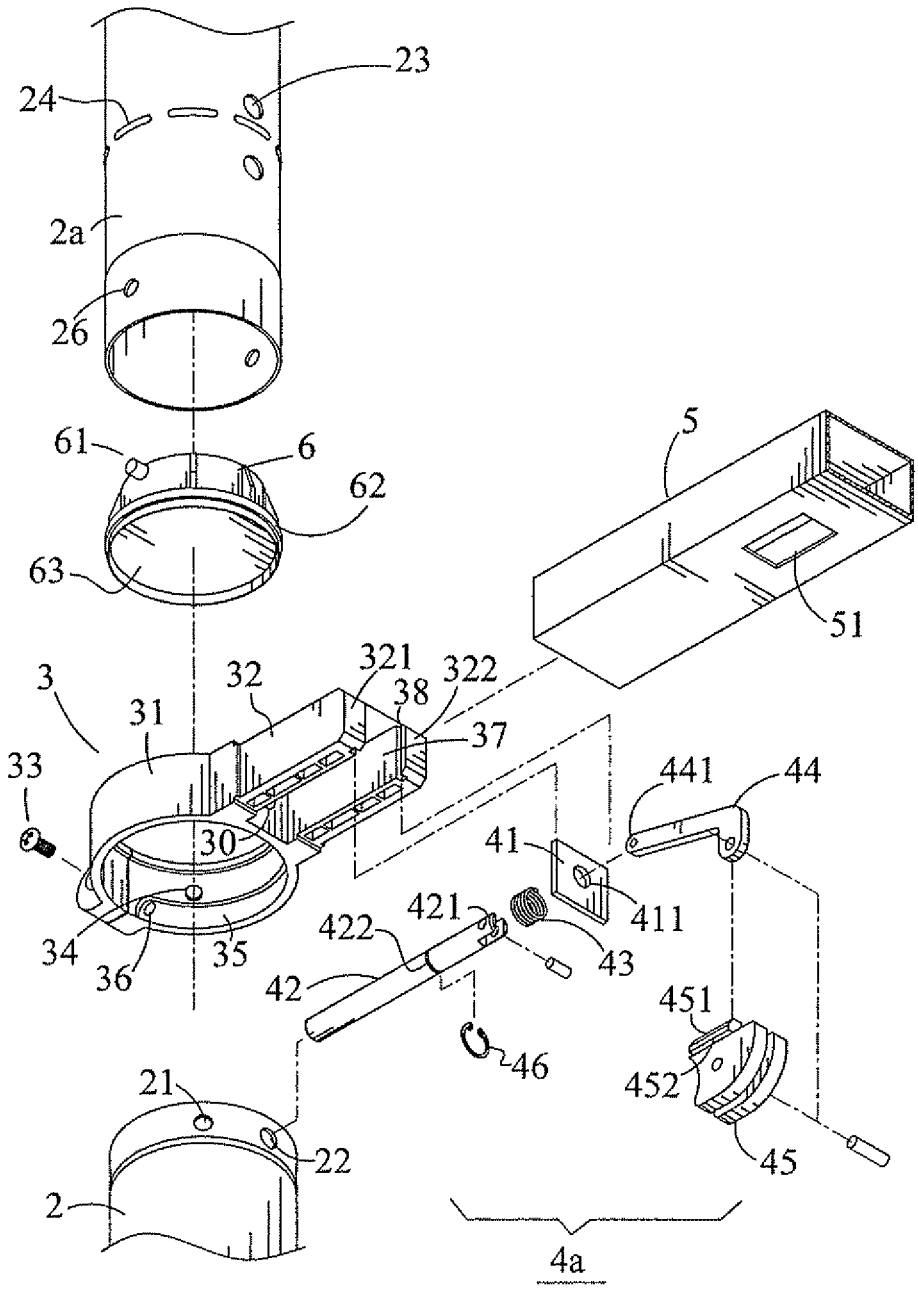
FIG. 4 is a three-dimensional exploded view of the first-length rung section and its locking mechanism.

Referring to FIG. 4, each side rail section 2 of the extension ladder in the present invention is hollow and tubular-shaped and can be fit in with each other. That is, the second side rail section 2*a*, which has a smaller diameter but the same shape with the first side rail section 2, can be fit into the first side rail section 2. The second side rail section 2*a* can be slid within the first side rail section. Other side rail sections can be fit in with each other accordingly.

As shown in FIG. 4, a snap-fit hole 21 and an orientation hole 22 are provided above the first side rail section so that the connection kit 3 can fit through the holes.

As shown in the figure, said connection kit 3 comprises a ring-shaped covering part 31 that can be fit on the upper end of a side rail section and a pivotal joint 32 extending from the ring-shaped covering part 31; after said ring-shaped covering part 31 is fit on the upper end of said side rail section by using a screw 33 to fix it, an orientation tenon 34 for embedding snap-fit hole 21 of the side rail section is provided on the internal wall the ring shaped covering part 31; an adhesive channel 35 is provided whose one end is provided with an adhesive-infusing hole 36 so that adhesive can be infused therein to stick the side rail section together; a via hole 30 is provided on the ring-shaped covering part 31. The via hole 30 is aligned with the orientation hole 22 of the side rail section after the ring-shaped covering part 31 is fit in with its upper end.

Said pivotal joint 32 is formed with the ring-shaped covering part 31 and a channel 37 is formed therein which is interlinked with the via hole 30. The two sides of said channel 37 are side plates 321 and 322. A upright opening 38 is provided on the internal wall of said side plates 321 and 322; a transverse step portion 5 is fits with the external part of the pivotal joint 32; a cross slot 51 is longitudinally provided on the lower surface of the transverse step portion 5.

A first-length locking mechanism 4*a*, is provided in the interior of the channel 37 of the first-length connection kit 3, which includes a block plate 41, a locking bar 42, a spring 43, a pull rod 44, and a control pad 45; said block plate 41 is inserted and fixed within the upright opening 38 of the block plate 41 and a cross hole 411 is formed in the center of said pivotal joint 32. After the joint part 441 of the pull rod 44 passes through the cross hole 411, it is jointed with the end connection 421 of the locking bar 42. One end of the locking bar 42 passes through the via hole 30 of the connection kit 3 and the orientation hole 22 of the side rail section 2. A narrow circumferential groove 422 is provided in the main body of the locking bar 42 for a C-shaped plate 46 to be inserted into the narrow groove 422 to restrain the spring 43. Accordingly, when the locking bar 42 is pushed and shifted by the pull rod 44, the spring 43 needs to be used to return the locking bar 42 to its original position.

The block plate 41, locking bar 2, spring 43, and pull rod 44 are disposed in the interior of the first-length locking mechanism 4*a* described above, and are covered by a transverse step portion 5. One end of the pull rod 44 is connected with the control pad 45 disposed under the transverse step portion 5, so that the movement of locking bar 42 can be controlled manually by the control pad 45; a guide plate 451 is disposed above the control pad 45, and a horizontal groove 452 is formed under the guide plate 451, which can push the guide plate 451 into the cross hole 51 of the transverse step portion 5. With the horizontal groove 452, sliding along the edge of the cross hole 51 is available.

Figure 5:
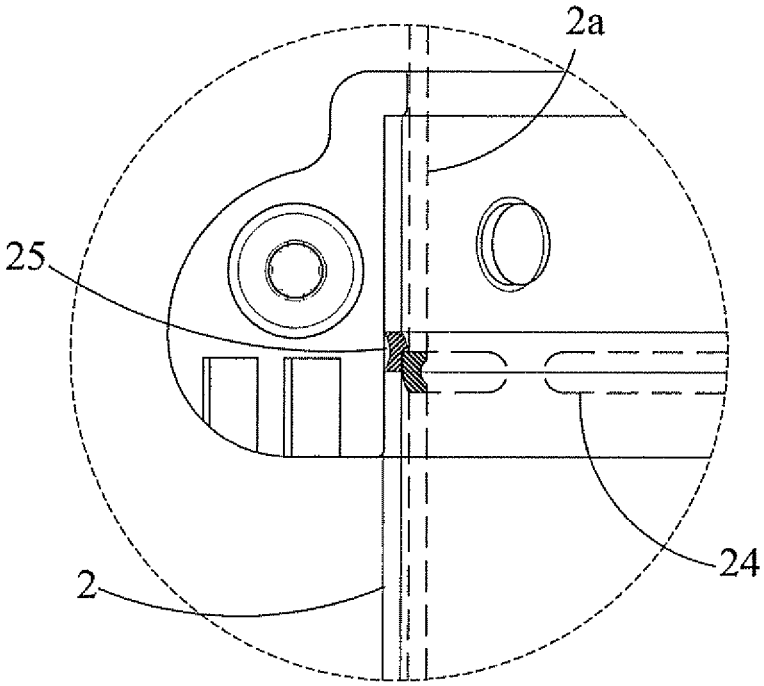
FIG. 5 is a partial sectional view of the embodiment in the present invention.

As shown in the figure, a through and fixing hole 23 is provided in the external part of the side rail section 2*a* above the second length; a out-protruding ring 24 is provided under the through and fixing hole 23; a corresponding in-protruding ring 25 (as shown in FIG. 5) is provided in the interior of the first-length side rail section 2. By way of the joint of the out-protruding ring 24 and in-protruding ring 25, the side rail section 2*a* is moved upward and downward within the first-length side rail section 2 so that the through and fixing hole 23 can be oriented to the orientation hole 22 of the first-length side rail section 2 and the locking bar 42 can pass through the through and fixing hole 23. Accordingly, the upper side rail section and lower side rail section can be extended and fixed to some extent.

In addition, a buckle hole 26 is disposed at the lower end of the side rail section 2*a* above the second length so that a buffering device 6 can be hooked in the buckle hole 26 of the side rail section through a protruding part 61 and can be fixed in the lower end of the side rail section 2*a*; an elastic seal ring 62 is disposed outside the lower end of the buffering device 6 so that appropriate friction remains from the internal wall of the side rail section since the elastic seal ring 62 is shifted upward and downward within the side rail section, which reduces the noise occurred. Said elastic seal ring 62 also has the folding cushion function. Also, a film 63 is disposed within the buffering device 6. A hole is formed on the film 63 so that air can get into the film 63 through the hole to achieve the cushion effect when the buffering device 6 is shifted upward and downward.

Figure 6:
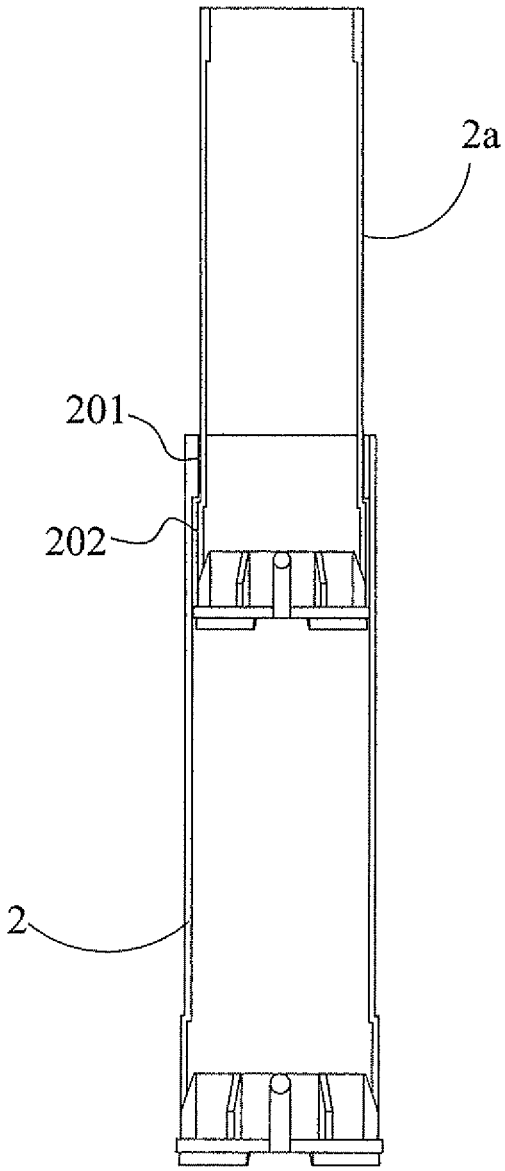
FIG. 6 is an exterior view of the rung section in the embodiment of the present invention.

As shown in FIG. 6, to avoid that two side rail sections depart from each other, an in-protruding encircling ring part 201 is provided at the upper tube opening of side rail section in the present invention; an out-protruding ring part 202 is provided at the lower tube opening of side rail section. Accordingly, after the upper side rail section passes upward through the lower side rail section, the encircling ring part 201 and protruding ring part 202 restrain from each other, which prevents the side rail sections from departing from each other and ensures the safety.

Figure 7:
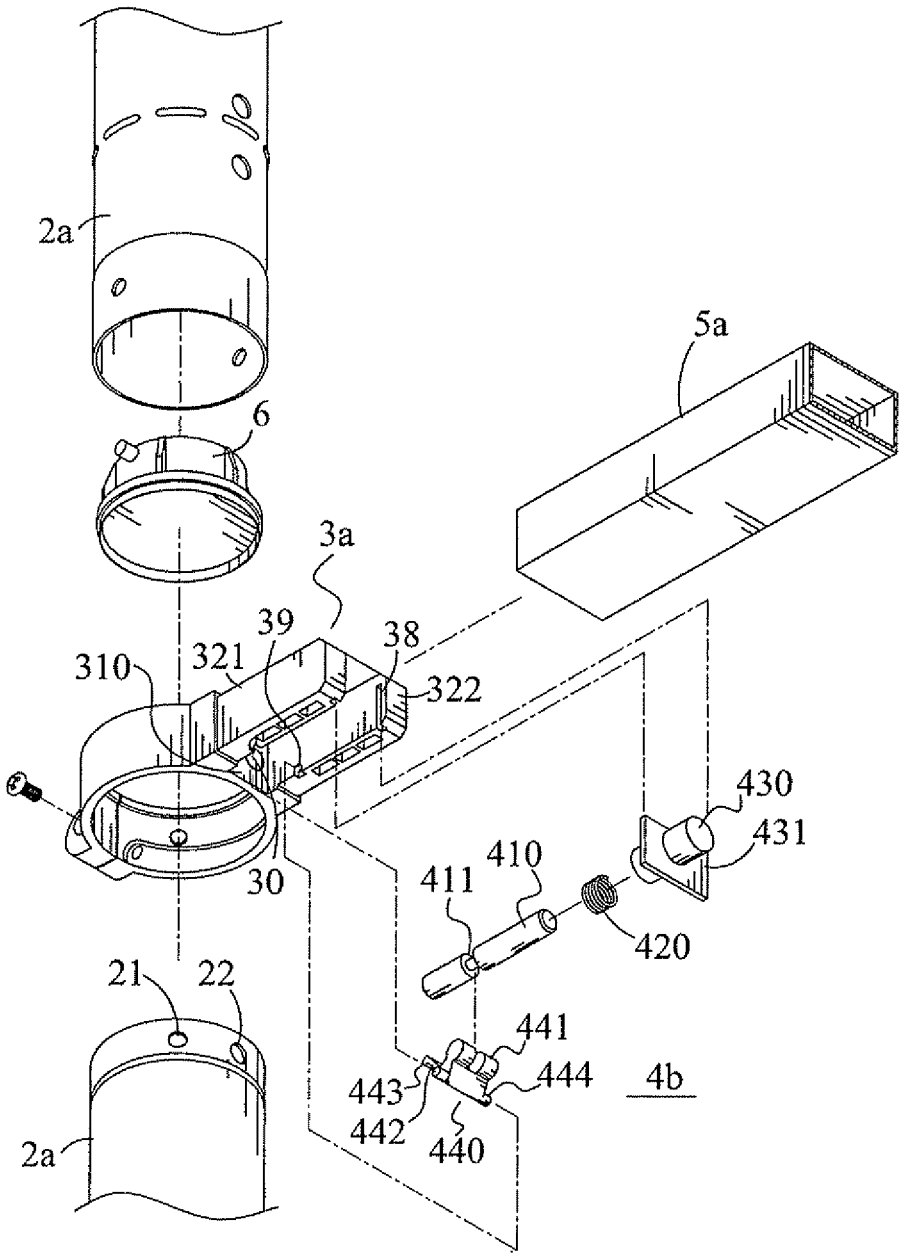
FIG. 7 is a three-dimensional exploded view of the rung section above the second length and its locking mechanism in the embodiment of the present invention.

Referring to FIG. 7, the upper locking mechanism 4*b*, upper connection kit 3*a*, and upper transverse step portion 5*a* of the side rail section 2*a* above the second length are different from those in the first length side rail section. A cross hole at the lower end of the upper transverse step portion 5*a* is not required.

As shown in the figure, the upper connection kit 3*a* not only has the structure of first-length connection kit 3 but also has an axial opening 39 on the internal wall of the side plates 321 and 322. Also, an opening 310 is provided at the bottom of the ring-shaped covering part 31 of connection kit 3*a* which is connected with the pivotal joint 32.

The upper locking mechanism 4*b* disposed within the upper connection kit 3*a* comprises a locking bar 410, a spring 420, a sleeve 430, and a turning rod 440. The sleeve 430 is provided with a upright plate 431. The two sides of the upright plate 431 can be inserted and fixed within the upright opening 38 of the pivotal joint 32. One end of the locking bar 410 can be fit into the sleeve 430. A spring 420 is provided at one end of the sleeve 430 inserted with the locking bar 410 so that the locking bar 410 can be switched horizontally and return back to its original position. A rabbet 411 is provided in the main body of the locking bar 410 for disposing the turning rod 440.

Figure 8:
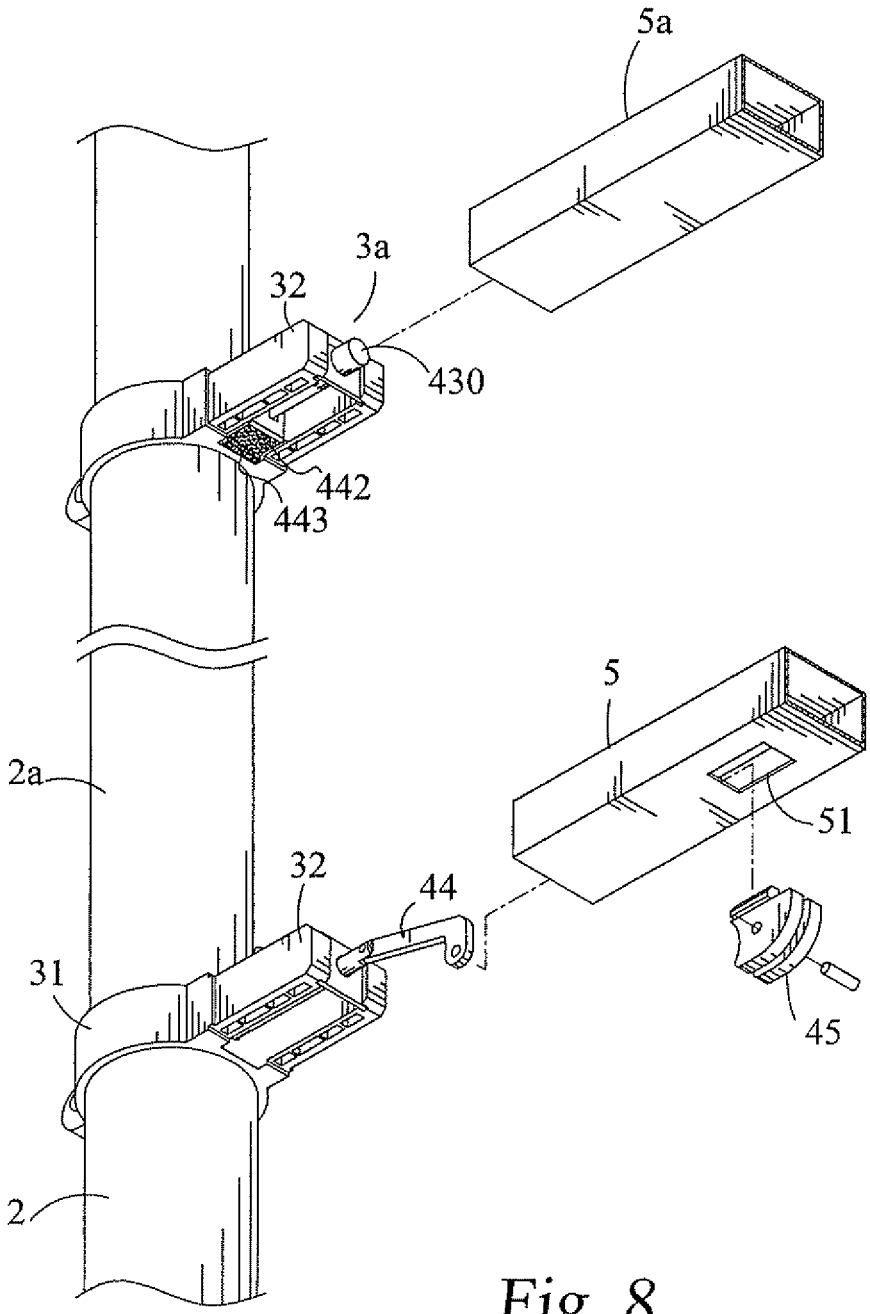
FIG. 8 is a three-dimensional assembly view of the embodiment in the present invention.

As shown in the figure, the turning rod 440, presented as V-shaped, has a yoke 441 at one end that can be inserted into the rabbet 411 of locking bar 410, and has a base plate 442 at another end; a downward protruding bump 443 is formed at the lower end of said base plate 442; a pivot 444 is formed in the joint of the yoke 441 and base plate 442 so that the turning rod 440 can be embedded into an axial opening 39 of the upper connection kit 3*a* through the pivot 444 and the bump 443 can be exposed from the opening 310 (as shown in FIG. 8).

Figure 9:
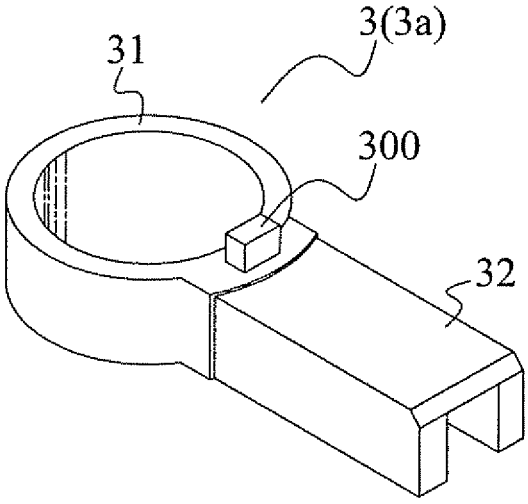
FIG. 9 is a three-dimensional view of the connection kits from another perspective in the embodiment of the present invention.

Referring to FIG. 9, regardless of the first-length connection kit 3 or upper connection kit 3*a*, a upward protruding fixing ejection bar 300 is provided at the upper end of the ring-shaped covering part 31. The fixing ejection bar 300 is formed with the connection kit 3(3*a*). Since it is formed at upper end of the ring-shaped covering part 31, it is not covered by the transverse step portion 5. Said fixing ejection bar 300 is oriented to the opening 310 of the upper connection kit 3*a*.

Figure 10:
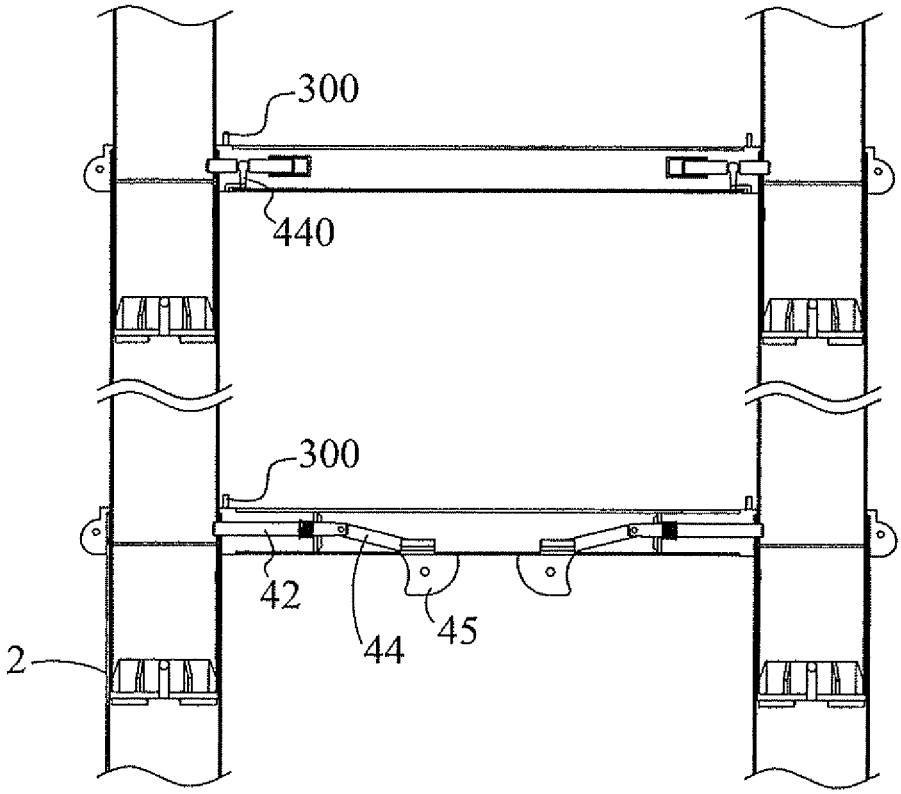
FIG. 10 is a plan view of the unfolded ladder in the embodiment of the present invention.
Figure 11:
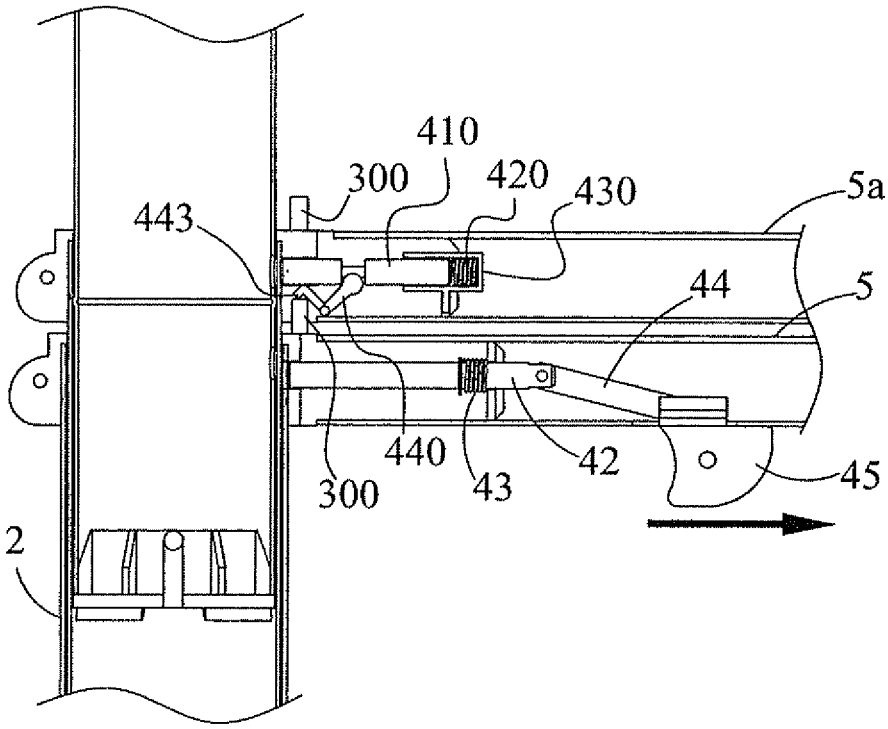
FIG. 11 is a plan view of the folded ladder in the embodiment of the present invention.

During implementation, as shown in FIGS. 10 and 11, when the control pad 45 is switched toward the center of the stepladder, through the pull rod 44, it drives the locking bar 42 to withdraw from the through and fixing hole 23 of the side rail section. The upper side rail section 2*a*, upper connection kit 3*a*, and upper transverse step portion 5*a* fall down after the locking bar 42 withdraws from the through and fixing hole 23. When the upper connection kit 3*a* falls down and sticks on the first-length connection kit 3 (as shown in FIG. 11), the fixing ejection bar 300 at the upper end of the first-length connection kit 3 enters into the opening 310 of the upper connection kit 3*a* while pushing the bump 443 of the turning rod 440 within the upper locking mechanism to rotate the turning rod 440 and then the locking bar 410 is pulled back through the yoke 441 of the turning rod 440. When the locking bar 410 withdraws from the through and fixing hole of the third-length side rail section, the third-length side rail section, connection kit, and transverse step portion fall down simultaneously, and the fixing ejection bar 300 of the third-length connection kit will be pushed against the fourth-length turning rod, and then the fourth-length side rail section, connection kit, and transverse step portion will fall down; accordingly, once the first-length control pad 45 is pushed, each length of the side rail sections will go down and be folded; also, through the setup of the buffering device 6 and elastic seal ring 62, each length of the side rail sections can cushion the extension or folding without any noise.

With the construction described above, the extension ladder in the present invention not only decreases the part cost but also increases the using reliability through the simplified structure. Also, the locking mechanism is hidden in the internal part which can avoid danger of touching the turning rod carelessly during unlocking.

Figure 12:
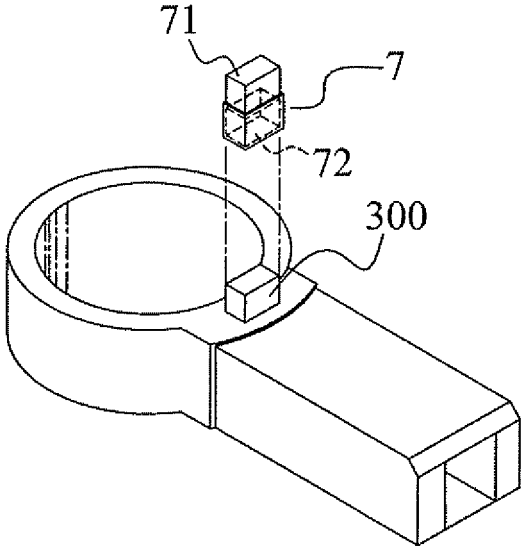
FIG. 12 is a three-dimensional view of the second embodiment of the present invention.

Referring to FIG. 12, in another embodiment of the extension ladder in the present invention, an unlocking bock 7 is additionally provided. A partition ejection bar 71 that is equal to the ejection bar is provided at the upper end of the unlocking bock 7; a groove for the ejection bar 72 that is equal to the ejection bar is provided at the lower end of the unlocking bock. When the unlocking bock 7 is fit into the upper end of the fixing ejection bar 300, the fixing ejection bar 300 is also pushed up.

Figure 13:
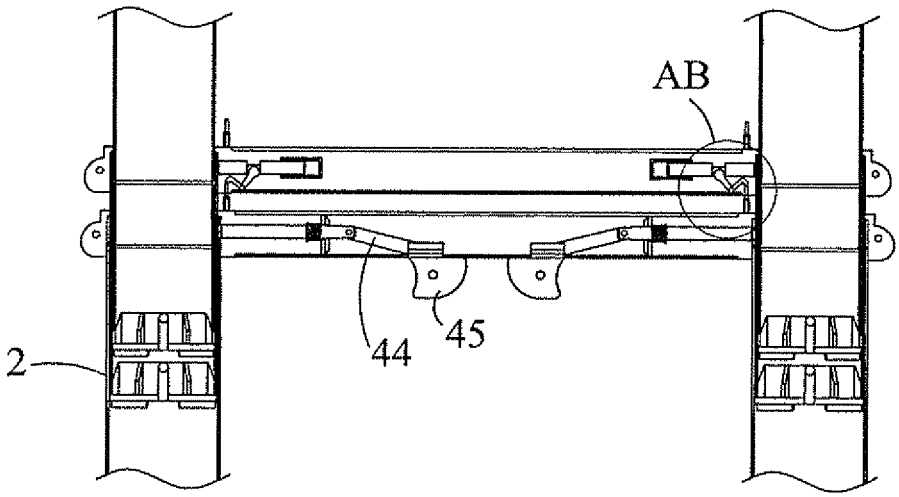
FIG. 13 is a plan view of the unfolded ladder in the second embodiment of the present invention.
Figure 14:
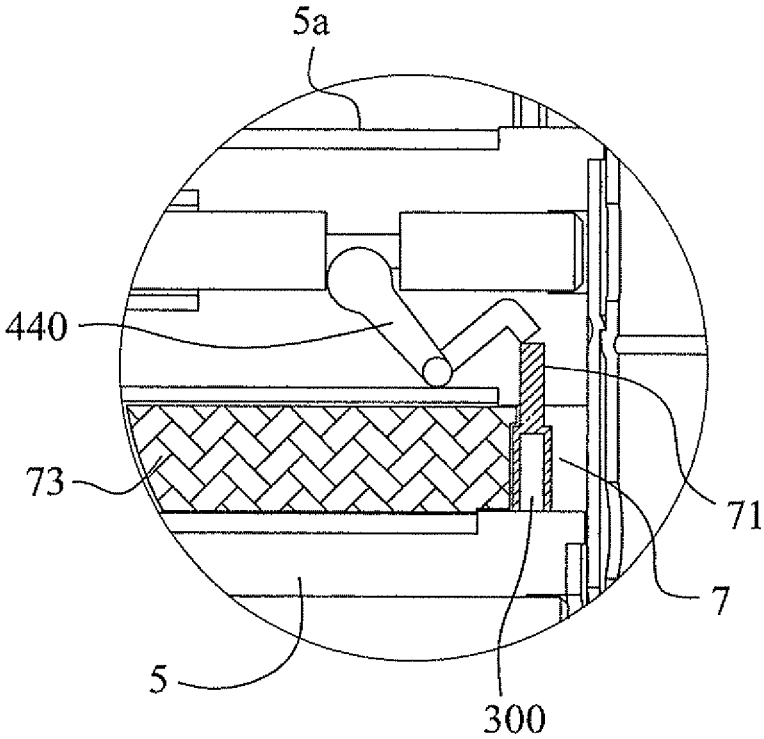
FIG. 14 is an enlarged view of the part AB of the FIG. 13.

Referring to FIGS. 13 and 14, since the unlocking bock 7 can be fit into the upper end of the fixing ejection bar 300, the turning rod 440 within the upper connection kit can be pushed through the partition ejection bar 71 to unlock, which not only will not impact the operation of the locking mechanism, but also renders a partition space 73 between the upper transverse step portion 5*a* and lower transverse step portion 5 during folding. The partition space 73 allows cables or wires to be passed through or allows operators who need to wear gloves in a long time to hold the ladder easily when the extension ladder is used in any specific location.

Figure 15:
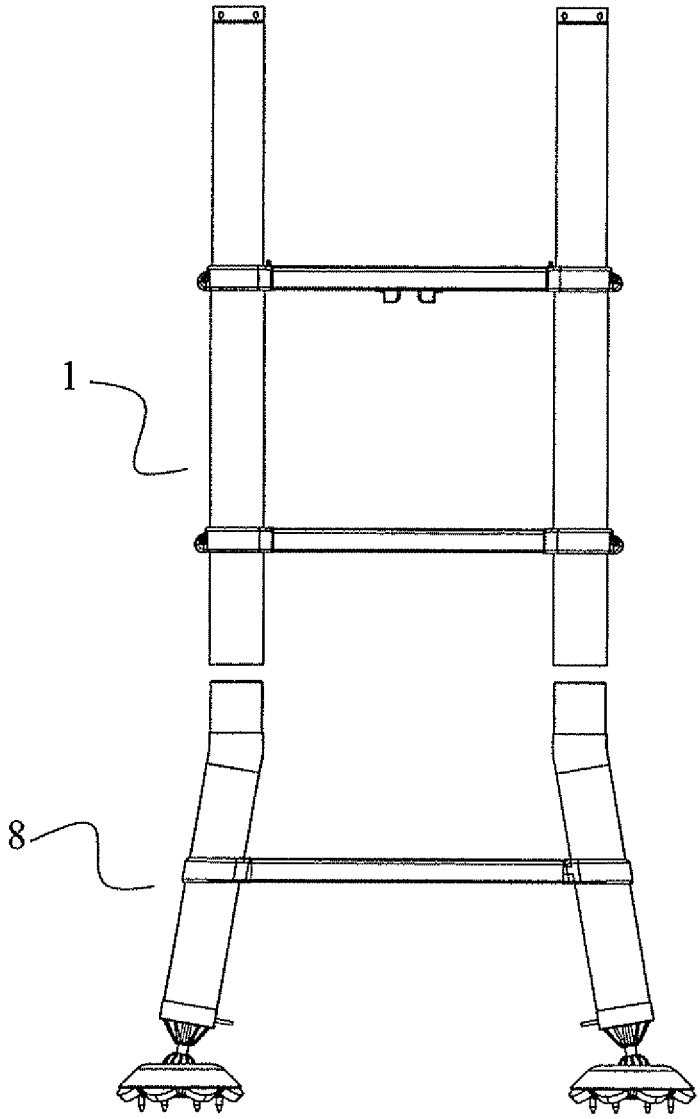
FIG. 15 is a plan view of the third embodiment of the present invention.

Referring to FIG. 15, in another embodiment of the extension ladder in the present invention, an adjustable or elastic support set 8 is provided at the lower end of extension ladder 1, which not only increases the basal area of the extension ladder, enhances the safety, but also provides more applicable locations based on different, uneven ground or step differences, and enhances the reliability.

Figure 16:
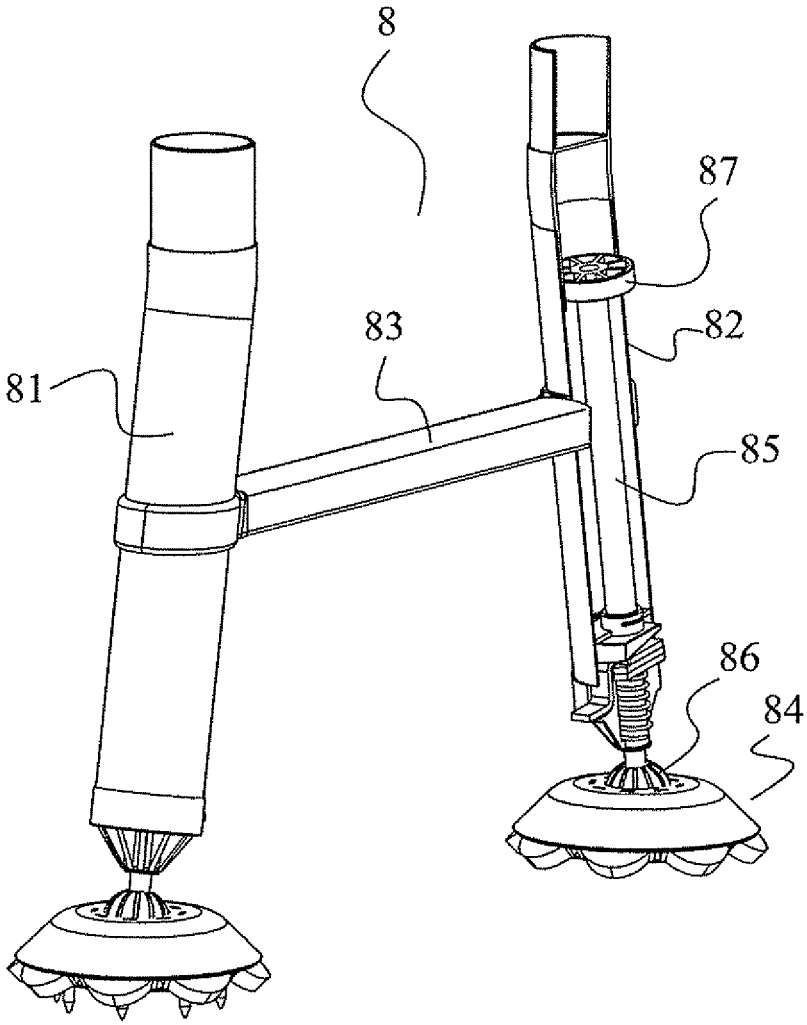
FIG. 16 is a three-dimensional view of the elastic support set in the third embodiment of the present invention.
Figure 17:
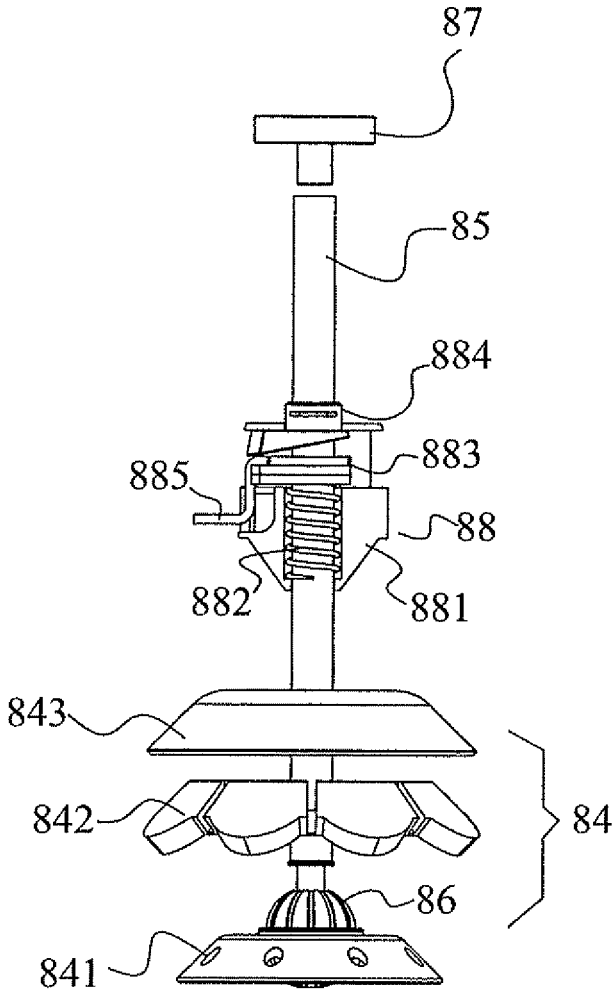
FIG. 17 is a partial plan view of the elastic support set in the third embodiment of the present invention.
Figure 18:
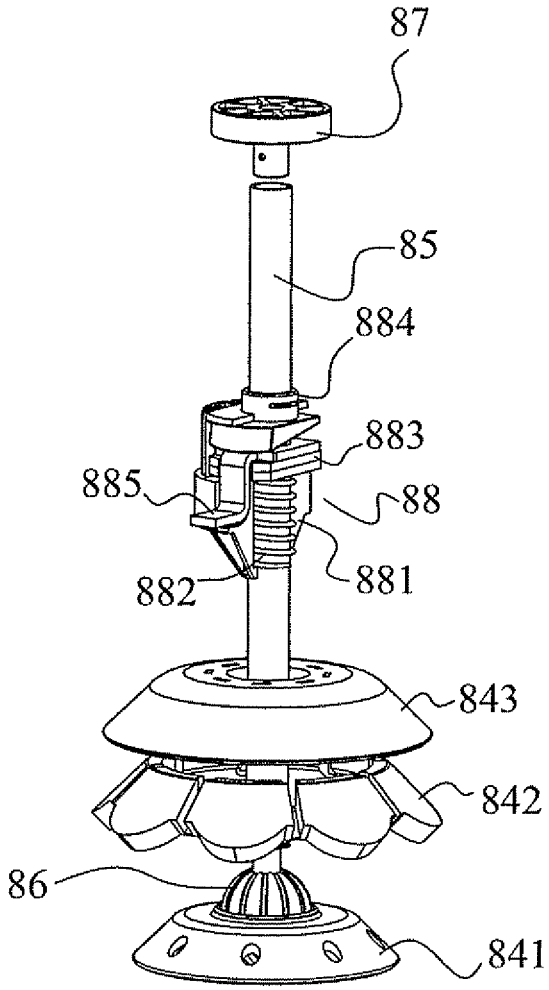
FIG. 18 is a partial three-dimensional view of the elastic support set in the third embodiment of the present invention.

Referring to FIGS. 16, 17, and 18, said elastic support set 8 comprises two rail portions 81, 82 that can be fit in with the side rail section; a step portion 83 is disposed between the two rail portions 81, 82; a pedestal 84 is disposed at the lower end of the rail portions 81, 82; an extension bar 85 is disposed at the upper end of said pedestal 84. A ball-shaped stand 86 is connected with a pedestal 84 at the lower end of the extension bar 85 so that the extension bar 85 can be rotated arbitrarily; a stable element 87 is disposed at the upper end of the extension bar 85 so that the extension bar 85 contacts with the internal wall of rail portions 81 and 82 through the stable element 87 without swaying. Said pedestal 84 comprises a rubber pad 841, a middle cover 842, and a upper cover 843. The middle cover 842 and upper cover 843 are hooked up with each other and cover the ball-shaped stand 86 so that the extension bar 85 can be adjusted and rotated.

In addition, a tensile control mechanism 88 is provided in the middle of the extension bar 85 which is formed through that a top inclined spring 882 is provided within a base 881. The upper end of said top inclined spring 882 is pushed against a one-way snap-fit iron sheet 883. The upper end of one-way snap-fit iron sheet 883 sticks on an inclined piece 884; a hole (not shown in the figure) is disposed at the center of the one-way snap-fit iron sheet 883 and inclined piece 884 so that the extension bar 85 can pass therethrough. Accordingly, when the one-way snap-fit iron sheet 883 is inclined, the extension bar 85 gets stuck through the inclined hole edge so that the extension bar 85 can only be pulled upward and cannot be pulled back, which ensures the safety of using the stepladder. Therefore, with the one-way snap-fit iron sheet 883, extension bar 85 can adjust the height difference of the ladder foothold.

A switch 885 is disposed in one end of the one-way snap-fit iron sheet 883. When the switch 885 is pushed up, the one-way snap-fit iron sheet 883 is pulled back as horizontal. At this time, since the extension bar 85 no longer gets stuck with the hole edge, the extension bar 85 can be pulled back arbitrarily.

Figure 19:
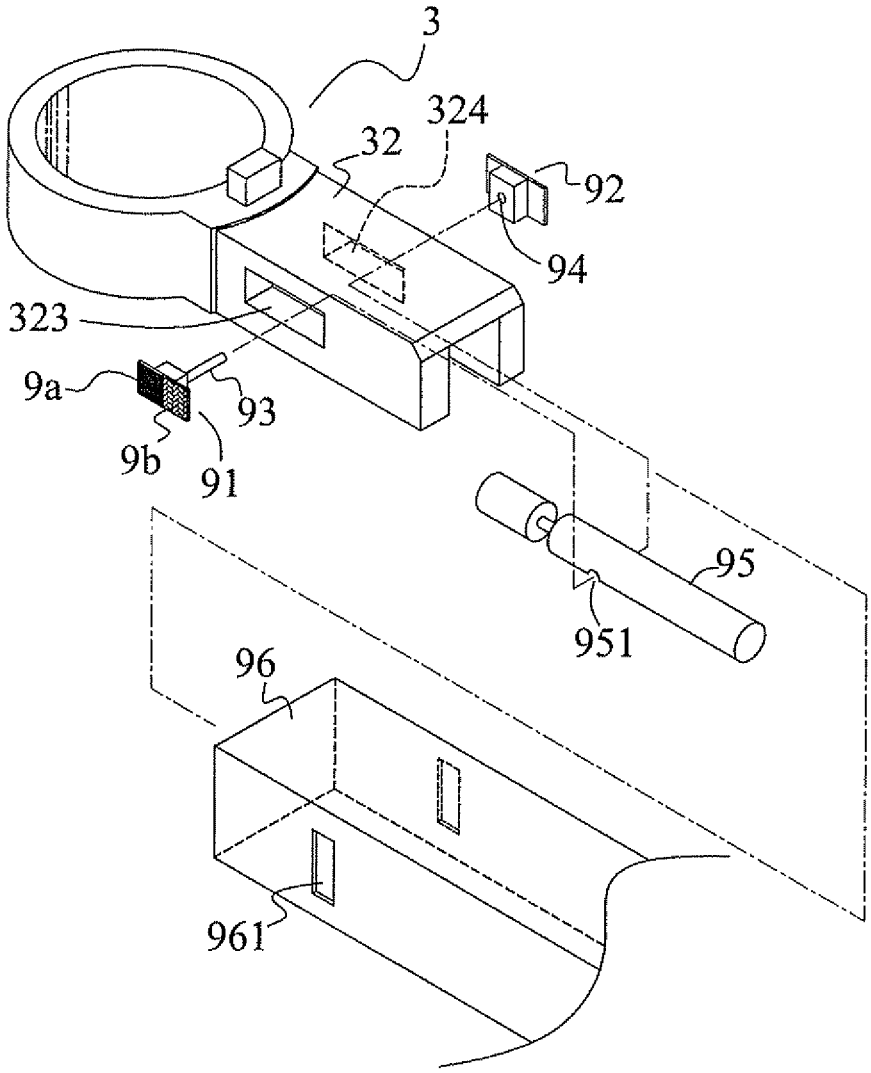
FIG. 19 is a three-dimensional exploded view of the fourth embodiment of the present invention.

Referring to FIG. 19, the extension ladder in the present invention is equipped with the locking display function. As shown in the figure, a window frame 323 or 324 is disposed respectively in the two sides of the pivotal joint 32 of connection kit 3. Two display cards 91 and 92 showing two sections 9*a* and 9*b* on their external surface respectively are disposed with the window frames 323 and 324, wherein a transverse bolt 93 is disposed at one end of the first display card 91; a transverse dowel hole 94 is disposed at one end of the second display card 92; a transverse hole 951 is disposed in the main body of the locking bar 95 so that the first display card 9 passes through the transverse hole 951 with the bolt 93, and then the second display card 92 is inserted into the dowel hole 94. A window opening 961 is provided at two sides of the transverse step portion 96 respectively for exposing the first section 9*a* or second section 9*b* of the display card.

Accordingly, through observing whether the first section 9*a* or second section 9*b* is displayed in the window opening 961, locking of the locking bar can be secured and application safety can be ensured.

Figure 20:
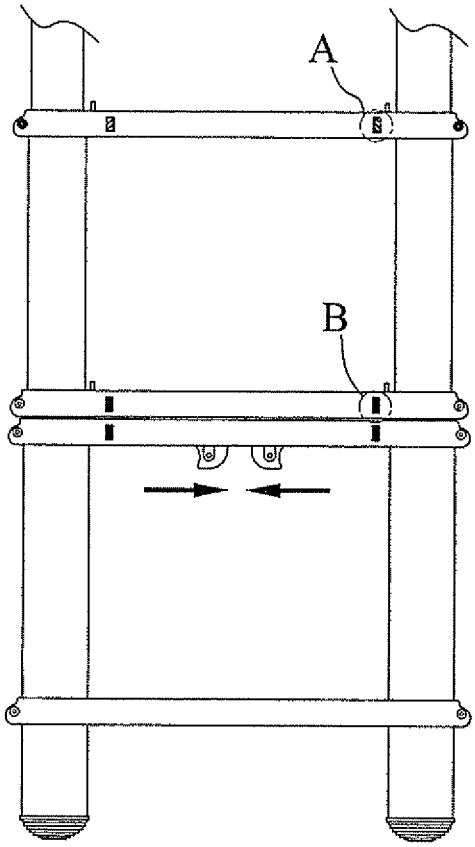
FIG. 20 is an illustration showing the folding of the extension ladder in the present invention.
Figure 21A:
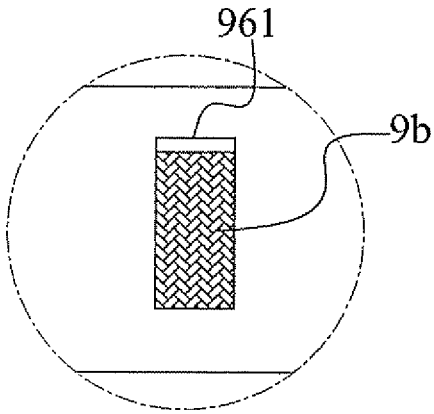
FIG. 21A is an enlarged view of the part A of the FIG. 20.
Figure 21B:
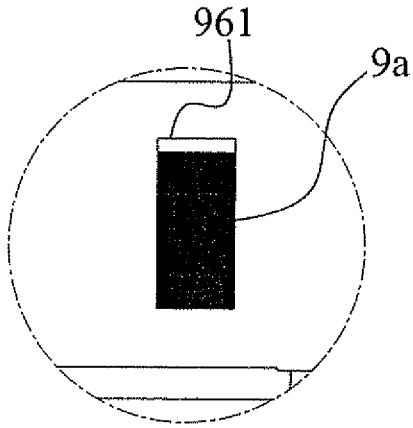
FIG. 21B is an enlarged view of the part B of the FIG. 20.

Therefore, referring to FIGS. 20, 21A, and 21B, wherein FIG. 21A is an enlarged view of the part A of the FIG. 20 showing that when the locking bar is inserted into the through and fixing hole of a side rail section, the second section 9*b* is displayed in the window opening 961; FIG. 21B is an enlarged view of the part B of FIG. 20 showing that after the locking bar is withdrawn from the through and fixing hole of the side rail section, the first section 9*a* is exposed in the window opening 961. Accordingly, whether the locking bar is locked and fixed can be confirmed from the outside of the window opening 961 and the safety can be enhanced.

Therefore, in the improvement of an extension ladder structure in the present invention, since a fixing ejection bar is disposed at the upper end of the connection kit, an in-protruding encircling ring part is disposed at the upper tube opening of the side rail section, and a out-protruding protruding ring part is disposed at the lower end of the side rail section, which can prevent the side rail sections from departing from each other and enhance the fabrication convenience and controllability. With the setup of the unlocking bock and elastic support set, the applicable scope and reliability is increased.

As described above, the extension ladder apparatus in the present invention certainly enhances appliance safety, and makes folding and using quick and convenient, which can improve the deficiencies of conventional ladders. Also, the present invention has not yet opened to public, it is then complied with the conditions of allowable patents.

Although the above-mentioned embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An improvement of an extension ladder structure, comprising, a plurality of side rail sections which are hollow and tubular-shaped, and which telescope with each other due to different internal diameters, wherein an orientation hole is provided on an end of the side rail sections;

a plurality of connection kits comprising a ring-shaped covering part which fits on an upper end of each of said side rail sections respectively, a via hole that is aligned with the orientation hole of said side rail sections is provided on the ring-shaped covering part; wherein one side of said ring-shaped covering part extends outward as a pivotal joint such that a channel is formed within the pivotal joint;

a plurality of transverse step portions cover and enclose an exterior of said pivotal joint;

a plurality of locking mechanisms, which are disposed within the channel of said pivotal joint, comprising:

a locking bar with a first end for passing through the via hole of said ring-shaped covering part and said orientation hole of the side rail sections;

a spring disposed at a second end of said locking bar so that the locking bar can return to an original location;

a plate for fixing the locking bar and the spring in a location in said channel; and a turning rod for pushing said locking bar to another location;

wherein a protruding ejection bar is disposed at an upper end of the ring-shaped covering part of said connection kit; said protruding ejection bar is oriented toward an opening of an upper connection kit; wherein, when the upper connection kit sticks on a lower connection kit, the protruding ejection bar of the lower connection kit pushes the turning rod within the upper connection kit so that the turning rod sways and drives the locking bar to withdraw from the orientation hole of an upper side rail section such that upper side rail sections can be telescoped in descending order, an in-protruding encircling ring part is provided at an upper tube opening of the side rail sections;

an out-protruding ring part is provided at a lower tube opening of the side rail sections; and further comprising an unlocking block fitted on the protruding ejection bar, wherein a groove is provided at a lower end of the unlocking block, which is fit onto an upper end of the ejection bar; an upward protruding ejection bar extension is provided at an upper end of the unlocking block; wherein, when the unlocking block is fit onto the upper end of the ejection bar, a space will be formed after an upper transverse step portion and a lower transverse step portion are telescoped.

2. The improvement of an extension ladder structure as claimed in claim 1, wherein said ejection bar is disposed upright and steadily.

3. The improvement of an extension ladder structure as claimed in claim 1, wherein said ejection bar is formed with the ring-shaped covering part of the connection kit.

4. The improvement of an extension ladder structure as claimed in claim 1, wherein said locking mechanism is provided within the lower connection kit; and wherein one end of the locking bar is connected with a transversely shiftable control pad that is disposed outside the transverse step portion through a connecting rod so that the control pad can be controlled from the outside and the side rail sections can be telescoped.

5. The improvement of an extension ladder structure as claimed in claim 1, wherein an adjustable support set is disposed at the bottom of the entire extension ladder for supporting the extension ladder on uneven ground or improving balance when there are height differences between steps and the ground.

6. The improvement of an extension ladder structure as claimed in claim 5, wherein said adjustable support set comprises:

a rail portion that can be fit in with the side rail section;

a pedestal disposed at the bottom of said rail portion;

an extension bar connected with said pedestal; or a tensile control mechanism that can adjust the extension of said extension bar.

7. The improvement of an extension ladder structure as claimed in claim 6, wherein a ball-shaped stand is connected with the pedestal at a lower end of the extension bar of said adjustable support set so that it can be adjusted to any angle.

8. The improvement of an extension ladder structure as claimed in claim 7, wherein said pedestal comprises a pad, a middle cover, and an upper cover, wherein said middle cover is hooked up with the upper cover and covers the ball-shaped stand so that the extension bar can be adjusted and rotated.

9. The improvement of an extension ladder structure as claimed in claim 6, wherein a top inclined spring is disposed within a base of said tensile control mechanism; an upper end of said top inclined spring is pushed against a one-way snap-fit iron sheet; an upper end of the one-way snap-fit iron sheet sticks on an inclined piece so that the extension bar can be adjusted downward arbitrarily; wherein, when the extension bar is adjusted upward, it will get stuck and stay fixed due to the one-way snap-fit iron sheet, such that the height difference of the ladder foothold can be adjusted.

10. The improvement of an extension ladder structure as claimed in claim 9, wherein a switch is disposed at one end of said one-way snap-fit iron sheet; wherein when the switch is pushed up, the one-way snap-fit iron sheet is pulled back horizontally so that the extension bar can be pulled back arbitrarily.

11. The improvement of an extension ladder structure as claimed in claim 1, wherein a set of display cards is provided which is formed with said locking bar so that it can be moved forward and backward with the locking bar; a window frame for the display cards to move forward and backward is provided on the pivotal joint of said ring-shaped covering part; a window opening for displaying a part of the display cards is provided on the transverse step portion so that the locking and stabilization of said locking bar can be confirmed through what is displayed in the display cards.

12. The improvement of an extension ladder structure as claimed in claim 11, wherein an external surface of said display cards has a first section showing a lock status of said locking bar and a second section showing an unlock status of said locking bar.

13. The improvement of an extension ladder structure as claimed in claim 11, wherein the set of display cards comprises two display cards in which a bolt is provided on one of the display cards and a dowel hole for inserting the bolt is provided on another display card; a transverse hole for the bolt to pass through is provided on the main body of said locking bar so that the two display cards can be connected with said locking bar and operated together.

14. An improvement of an extension ladder structure, comprising, a plurality of side rail sections which are hollow and tubular-shaped, and which telescope with each other due to different internal diameters, wherein an orientation hole is provided on an end of the side rail sections;

a plurality of connection kits comprising a ring-shaped covering part which fits on an upper end of each of said side rail sections respectively, a via hole that is aligned with the orientation hole of said side rail sections is provided on the ring-shaped covering part; wherein one side of said ring-shaped covering part extends outward as a pivotal joint such that a channel is formed within the pivotal joint;

a plurality of transverse step portions cover and enclose an exterior of said pivotal joint;

a plurality of locking mechanisms, which are disposed within the channel of said pivotal joint, comprising:

a locking bar with a first end for passing through the via hole of said ring-shaped covering part and said orientation hole of the side rail sections;

a spring disposed at a second end of said locking bar so that the locking bar can return to an original location; and a plate for fixing the locking bar and the spring in a location in said channel; and a turning rod for pushing said locking bar to another location;

wherein a protruding ejection bar is disposed at an upper end of the ring-shaped covering part of said connection kit; said protruding ejection bar is oriented toward an opening of an upper connection kit; wherein, when the upper connection kit sticks on a lower connection kit, the protruding ejection bar of the lower connection kit pushes the turning rod within the upper connection kit so that the turning rod sways and drives the locking bar to withdraw from the orientation hole of an upper side rail section such that upper side rail sections can be telescoped in descending order, an in-protruding encircling ring part is provided at an upper tube opening of the side rail sections;

an out-protruding ring part is provided at a lower tube opening of the side rail sections; and wherein, a set of display cards is provided which is formed with said locking bar so that it can be moved forward and backward with the locking bar; a window frame for the display cards to move forward and backward is provided on the pivotal joint of said ring-shaped covering part; a window opening for displaying a part of the display cards is provided on the transverse step portion so that the locking and stabilization of said locking bar can be confirmed through what is displayed in the display cards; wherein an external surface of said display cards has a first section showing a lock status of said locking bar and a second section showing the unlock status of said locking bar.

15. The improvement of an extension ladder structure as claimed in claim 14, wherein the set of display cards comprises two display cards in which a bolt is provided on one of the display cards and a dowel hole for inserting the bolt is provided on another display card; a transverse hole for the bolt to pass through is provided on the main body of said locking bar so that the two display cards can be connected with said locking bar and operated together.

* * * * *